US007459040B1

(12) United States Patent
Watson

(10) Patent No.: US 7,459,040 B1
(45) Date of Patent: Dec. 2, 2008

(54) METHOD FOR MAKING A STEEL ARTICLE WITH CARBIDES ALREADY IN THE STEEL AND NO DEFORMATION USED IN THE PROCESS

(76) Inventor: Daniel Watson, 350 Jennifer La., Driftwood, TX (US) 78619

( * ) Notice: Subject to any disclaimer, the term of this patent is extended or adjusted under 35 U.S.C. 154(b) by 436 days.

(21) Appl. No.: 11/141,454

(22) Filed: May 31, 2005

Related U.S. Application Data

(60) Provisional application No. 60/582,286, filed on Jun. 23, 2004.

(51) Int. Cl.
*C21D 9/00* (2006.01)

(52) U.S. Cl. ..... 148/660; 148/548

(58) Field of Classification Search ..... 148/326, 148/328, 547–548, 607–624, 579, 321–324, 148/648–654, 660, 661; 420/9–12
See application file for complete search history.

(56) References Cited

U.S. PATENT DOCUMENTS

| | | | | |
|---|---|---|---|---|
| 4,448,613 | A | 5/1984 | Sherby et al. | |
| 4,769,214 | A | 9/1988 | Sherby et al. | |
| 5,445,685 | A | 8/1995 | Strum et al. | |
| 6,395,108 | B2 * | 5/2002 | Eberle et al. | 148/330 |

FOREIGN PATENT DOCUMENTS

| | | | |
|---|---|---|---|
| JP | 56-133445 | * | 10/1981 |
| JP | 09-137247 | * | 5/1997 |
| JP | 2000-273537 | * | 10/2000 |

OTHER PUBLICATIONS

Tne computer-generated English translation of Japanese patent 2000-273537, Oct. 3, 2000, Suzuki, Mashito et al.*
Computer-generated English translation of Japanese patent 09-137247, Anami, Goro et al. dated May 27, 1997.*
Verhoeven, John D., A Review of Microsegregation Induced Banding Phenomena in Steels, Journal of Materials Engineering and Performance, vol. 9(3) Jun. 2000, pp. 286-296.
Sword Forum International, found at http://forums.swordforum.com/showthread.php?t=11162, as of Dec. 20, 2007.

* cited by examiner

*Primary Examiner*—Deborah Yee
(74) *Attorney, Agent, or Firm*—Buskop Law Group, PC; Wendy Buskop

(57) ABSTRACT

The invention is a method of making a steel article comprising carbide banding by using steel with undissolved carbides distributed within the steel, wherein the steel is about 0.3 weight percent to about 2.2 weight percent carbon and at least 0.003 weight percent of chromium, molybdenum, aluminum, vanadium, tungsten, or a similar carbide forming element; then, heating the steel with carbides for a time ranging between about 5 minutes to about 12 hours at a temperature above an A-sub 1 temperature and below 50 degrees Fahrenheit of an A-sub 3 temperature to form an austenitic steel with undissolved carbides; and cooling the austenitic steel with undissolved carbides to maintain the undissolved carbides within a chosen crystalline matrix creating carbide banding in the steel.

25 Claims, 4 Drawing Sheets

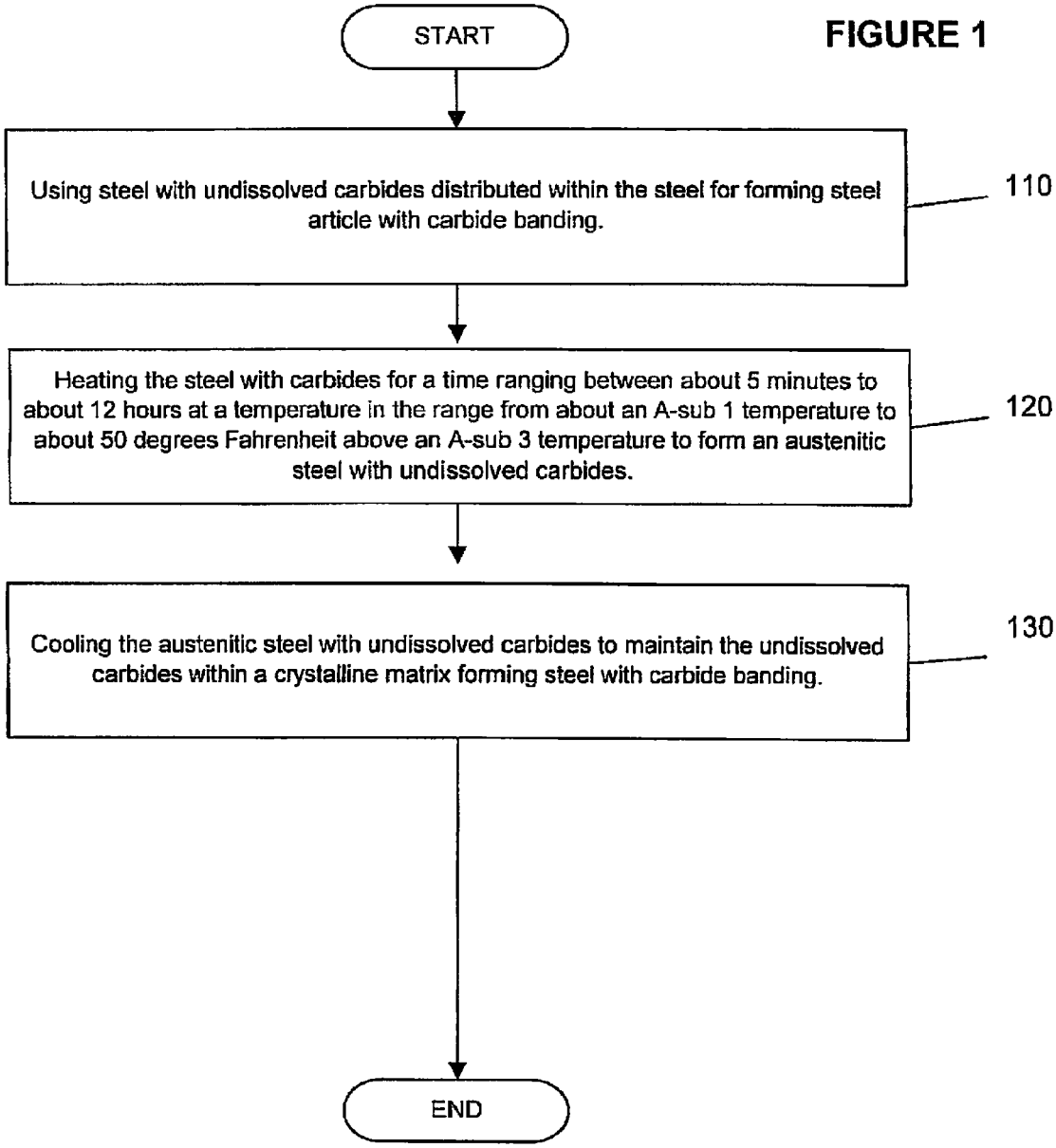
START
FIGURE 1
Using steel with undissolved carbides distributed within the steel for forming steel article with carbide banding.
110
Heating the steel with carbides for a time ranging between about 5 minutes to about 12 hours at a temperature in the range from about an A-sub 1 temperature to about 50 degrees Fahrenheit above an A-sub 3 temperature to form an austenitic steel with undissolved carbides.
120
Cooling the austenitic steel with undissolved carbides to maintain the undissolved carbides within a crystalline matrix forming steel with carbide banding.
130
END

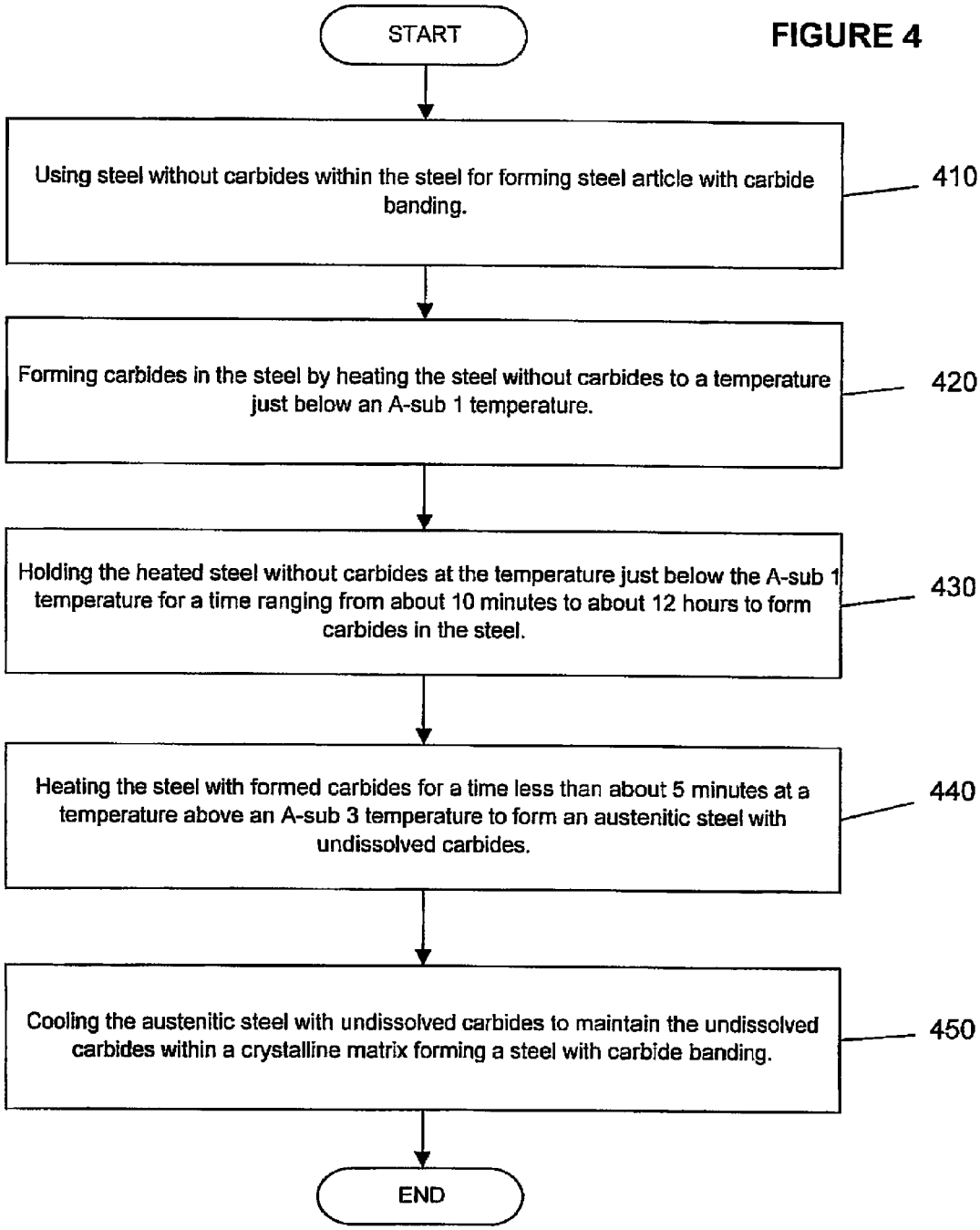
START
FIGURE 4
Using steel without carbides within the steel for forming steel article with carbide banding.
410
Forming carbides in the steel by heating the steel without carbides to a temperature just below an A-sub 1 temperature.
420
Holding the heated steel without carbides at the temperature just below the A-sub 1 temperature for a time ranging from about 10 minutes to about 12 hours to form carbides in the steel.
430
Heating the steel with formed carbides for a time less than about 5 minutes at a temperature above an A-sub 3 temperature to form an austenitic steel with undissolved carbides.
440
Cooling the austenitic steel with undissolved carbides to maintain the undissolved carbides within a crystalline matrix forming a steel with carbide banding.
450
END

METHOD FOR MAKING A STEEL ARTICLE WITH CARBIDES ALREADY IN THE STEEL AND NO DEFORMATION USED IN THE PROCESS

CROSS REFERENCE TO RELATED APPLICATIONS

The present application claims priority to U.S. Provisional Patent Application Ser. No. 60/582,286 filed on Jun. 23, 2004.

FIELD

The present embodiments relate generally to a method of making a steel article comprising carbide banding.

BACKGROUND

A need exists for a process to treat metals and similar materials of manufacture in order to increase their structural characteristics. For example, in the manufacture of tools and tool components, machinery, engine parts, wear surfaces and like articles from various steels and materials that are used for high wear applications, the common practice is to subject the steel to one or more thermal process treatments, either before or after formation of the steel carbide, so as to modify the properties of at least the exterior of the components. These treatments provide the articles with greater strength, enhanced conductivity, greater toughness, enhanced flexibility, longer wear life, and the like.

A number of thermal type processes are known in the metallurgical arts to enhance the properties of manufacturing materials, such as steels and the like. One widely used class of such metallurgical processes generally known as quenching can involve forming an article of the desired metal containing material and then rapidly lowering the temperature of the article followed by a return of the article to ambient temperature. The problem with the current processes controlled or not, is the formation of residual stress in the material. This results in stressing the material and even possibly fracturing the material rendering it useless.

A further enhancement process for manufacturing materials, such as steel, is in the formation of a nitride containing layer on the surface of an article of the metal containing material that hardens the material by forming nitrides such as metal nitrides at or near the surface of an article. The formed nitride surface layer can include extremely hard compounds containing nitrides such as CrN, Fe2N, Fe3N and Fe4N. The formed nitride layer tends to create compressive stresses that improve the properties of the metal containing material, but can also lead to distortions in the article being treated.

The current art describes single wave processes that concentrate on the cryogenic target temperature and possibly one positive range temperature. The focus of the current art on the cryogenic target temperature does not give any regard to the material being treated. The cryogenic phase causes stress in the metal and the subsequent heat process also causes stress in the material. The prior art has done little to deal with these secondary stresses.

A need, therefore, exists, for multi-wave thermal treatments in which the target temperatures are dictated by the material being treated.

A need has long existed for a thermal process to treat a metal or article of manufacture to improve its structural characteristics.

The present embodiments meet these needs.

SUMMARY

The invention relates to a method of making a steel article comprising carbide banding. The method uses steel with undissolved carbides distributed within the steel. The steel is about 0.3 weight percent to about 2.2 weight percent carbon and at least about 0.003 weight percent of a metal selected from the group consisting of chromium, molybdenum, aluminum, vanadium, tungsten, and a similar carbide forming element.

The method continues by heating the steel with carbides for a time ranging between about 5 minutes to about 12 hours at a temperature in the range from about an A-sub 1 temperature to about 50 and below 50 degrees Fahrenheit above an A-sub 3 temperature to form an austenitic steel with undissolved carbides. The method ends by cooling the austenitic steel with undissolved carbides to maintain the undissolved carbides within a chosen crystalline matrix creating carbide banding in the steel.

BRIEF DESCRIPTION OF THE DRAWINGS

The detailed description will be better understood in conjunction with the accompanying drawings as follows:

FIG. 1 is a schematic of an embodiment of the method.

FIG. 4 is a schematic of an alternative embodiment of the method.

Figure 2:
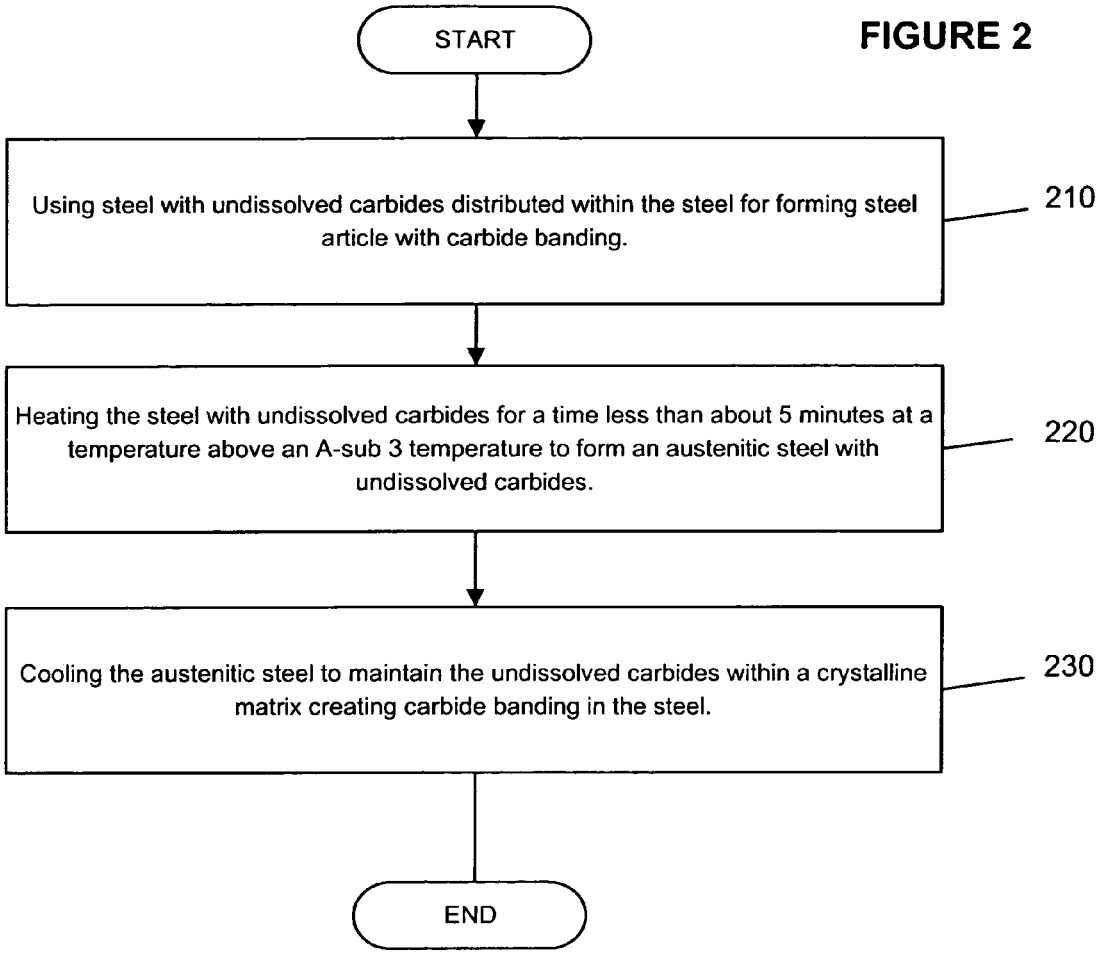
FIG. 2 is a schematic of an alternative embodiment of the method.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that they can be practiced or carried out in various ways.

The present invention is directed to a method of making a steel article with carbide banding.

The steel used in the method is composed of about 0.3 weight percent to about 2.2% weight carbon and at least about 0.003% weight of a particular metal. Examples of particular metals contemplated in this invention are chromium, molybdenum, aluminum, vanadium, tungsten, or similar carbide forming elements.

With reference to the Figures, FIG. 1 shows a schematic of the overall invention.

As shown in FIG. 1, the method begins by using steel with undissolved carbides distributed within the steel for forming a steel article with carbide binding (110). The next step entails heating the steel with carbides for a time ranging between about 5 minutes to about 12 hours. In an alternative embodiments the range can be from about 20 minutes to about 40 minutes. The heating occurs at a temperature above an A-sub 1 temperature, for example at least 1330 degrees Fahrenheit, and can range to about 50 degrees Fahrenheit above an A-sub 3 temperature to form austenitic steel with undissolved carbides (120). The method ends by cooling the austenitic steel with undissolved carbides to maintain the undissolved carbides within a crystalline matrix, creating carbide banding in the steel (130). The cooling step occurs at a time ranging from about 1 second to about 3 hours.

In an alternative, as seen in FIG. 2, an embodiment for a method begins by using steel with undissolved carbides within the steel to create steel article with carbide (210). The method continues by heating the steel with undissolved carbides for a time less than about 5 minutes at a temperature above an A-sub 3 temperature to form an austenitic steel with undissolved carbides (220). The heating can be performed at the A-sub 3 temperature ranging from about 1375 degrees Fahrenheit to about 2100 degrees Fahrenheit. The austenitic steel is, then, cooled, to maintain the undissolved carbides within a chosen crystalline matrix creating carbide banding in the steel (230).

Figure 3:
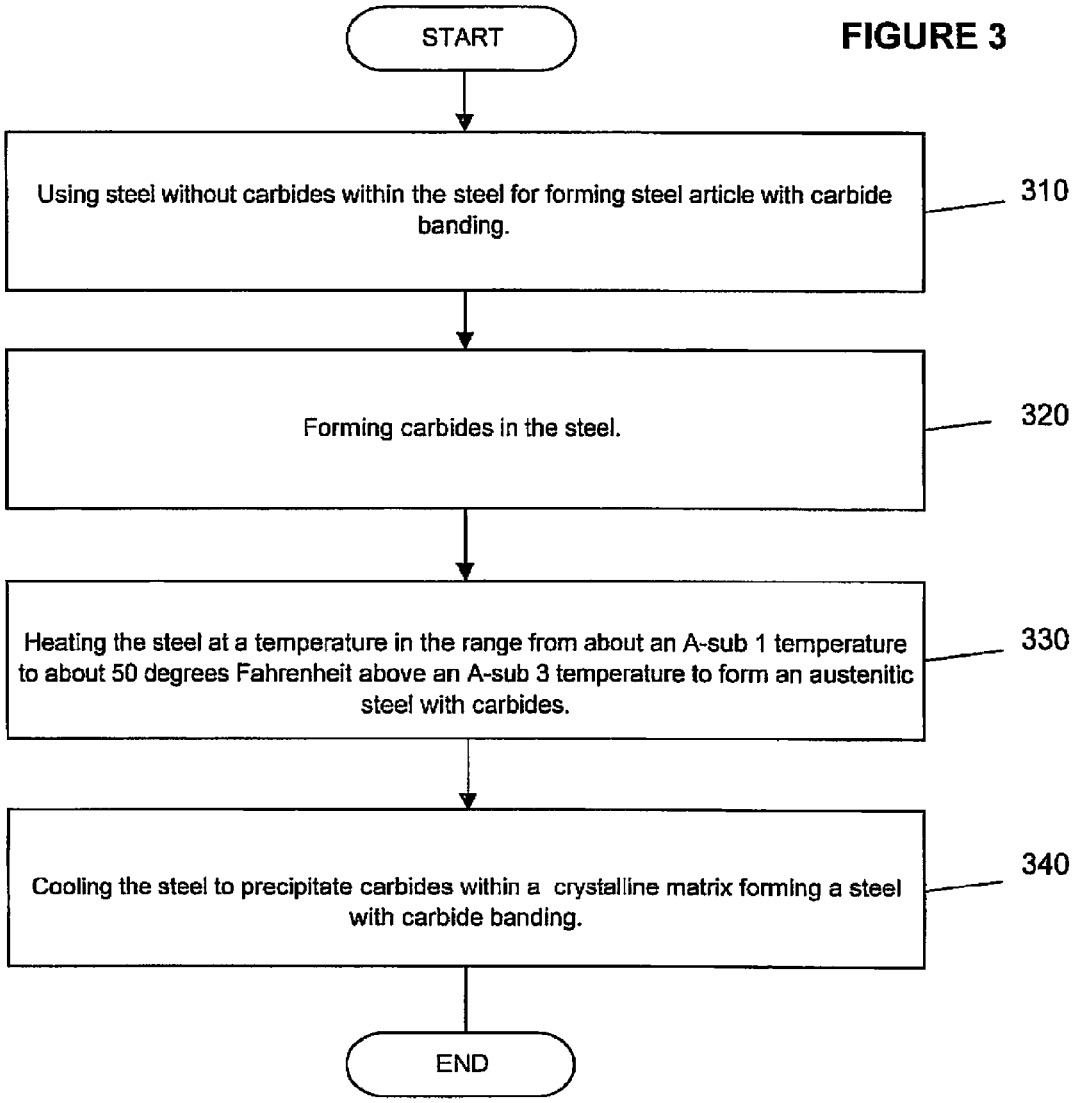
FIG. 3 is a schematic of an alternative embodiment of the method.

As shown in FIG. 3, the invention also contemplates a method of making a steel article comprising carbide banding by using steel without carbides within the steel for forming the steel article (310). The carbides are formed by cyclically heating the steel without carbides at temperatures just above and just below the A-sub 1 temperature. The next step entails forming carbides in the steel (320) by heating the steel to a temperature just below an A-sub 1 temperature and holding the heated steel at the temperature just below the A-sub 1 temperature for a time ranging from about 10 minutes to about 12 hours. Next, the steel is heated at a temperature ranging from about an A-sub 1 temperature to a temperature about 50 degrees Fahrenheit above an A-sub 3 temperature. Finally, the steel is cooled to precipitate carbides within a crystalline matrix, forming a steel with carbide banding (340).

The invention is also a method of making a steel article comprising carbide banding, as shown in FIG. 4. The method begins by using steel without carbides within the steel to form steel article with carbide banding (410). Carbides are formed by heating the steel without carbides to a temperature just below an A-sub 1 temperature (420) and holding the heated steel at the temperature just below the A-sub 1 temperature for a time ranging from about 10 minutes to about 12 hours to form carbides in the steel (430). The method continues by heating the steel with formed carbides for a time less than about 5 minutes at a temperature above an A-sub 3 temperature forming an austenitic steel with undissolved carbide (440). The last step is cooling the austenitic steel with undissolved carbides to maintain the undissolved carbides within a chosen crystalline matrix (450) forming a steel with carbide banding.

The invention contemplates that the materials in the methods can be varied. The crystalline matrix can be pearlite, austenite, ferrite, martensite, tempered martensite, bainite, or combinations thereof. The steel with undissolved carbides can be stainless steel, carbon steel, tool steel, or a steel alloy.

The step of cooling the austenitic steel with undissolved carbides is by air cooling. In the alternative, the step of cooling the austenitic steel with undissolved carbides is by quenching. The quenching process can be done by oil quenching, water quenching, salt quenching, or air quenching.

In the alternative, the cooling step takes place slowly at a temperature from just above 1330 degrees Fahrenheit to create a pearlite and ferrite crystalline matrix. The cooling time for this alternative is from about 5 minutes to about 6 hours.

While these embodiments have been described with emphasis on the embodiments, it should be understood that within the scope of the appended claims, the embodiments might be practiced other than as specifically described herein.

What is claimed is:

1. A method of making a steel article comprising carbide banding comprising the steps of:

a. obtaining steel with undissolved carbides distributed within the steel, wherein the steel comprises:
   i. about 0.3 weight percent to about 2.2 weight percent carbon; and
   ii. at least 0.003 weight percent of a metal selected from the group consisting of chromium, molybdenum, aluminum, vanadium, or tungsten;
b. heating the steel with carbides for a time ranging between about 5 minutes to about 12 hours at a temperature in the range from about an A-sub 1 temperature to about 50 degrees Fahrenheit above an A-sub 3 temperature to form an austenitic steel with undissolved carbides; and
c. cooling the austenitic steel with undissolved carbides to maintain the undissolved carbides within a crystalline matrix creating carbide banding in the steel.

2. The method of claim 1, wherein the crystalline matrix is pearlite, austenite, ferrite, martensite, tempered martensite, bainite, or combinations thereof.

3. The method of claim 1, wherein the steel with undissolved carbides is a member selected from the group consisting of a stainless steel, a carbon steel, a tool steel, and an steel alloy.

4. The method of claim 1, wherein the heating is performed above the A-sub 1 temperature of at least 1330 degrees Fahrenheit.

5. The method of claim 1, wherein the A-sub 3 temperature ranges from about 1375 degrees Fahrenheit to about 2100 degrees Fahrenheit.

6. The method of claim 1, wherein the step of heating of the steel occurs for a time ranging from about 20 minutes to about 40 minutes.

7. The method of claim 1, wherein the step of cooling of the heated steel occurs at a time ranging from about 1 second to about 3 hours.

8. The method of claim 1, wherein the step of cooling the austenitic steel with undissolved carbides is by air cooling or quenching.

9. The method of claim 8, wherein the step of quenching is by a member selected from the group consisting of: oil quenching, water quenching, salt quenching or air quenching.

10. The method of claim 1, wherein the step of cooling the austenitic steel with undissolved carbides is performed slowly at a temperature from just above 1330 degrees Fahrenheit to create a pearlite and ferrite crystalline matrix.

11. The method of claim 10, wherein the step of cooling the steel slowly is performed at a time ranging from about 5 minutes to about 6 hours.

12. A method of making a steel article comprising carbide banding, comprising the steps of:

a. obtaining steel without carbides distributed within the steel, wherein the steel comprises:
   i. from about 0.3 weight percent to about 2.2 weight percent carbon; and
   ii. at least about 0.003 weight percent of a metal selected from the group consisting of chromium, molybdenum, aluminum, vanadium, or tungsten;
b. forming carbides in the steel;
c. heating the steel at a temperature in the range from about an A-sub 1 temperature to about 50 degrees Fahrenheit above an A-sub 3 temperature, for a time ranging from about 20 minutes to about 40 minutes to form an austenitic steel with undissolved carbides; and
d. cooling the steel to precipitate carbides within a crystalline matrix and creating carbide banding in the steel.

13. The method of claim 12, wherein the crystalline matrix consists of pearlite, austenite, ferrite, martensite, tempered martensite, bainite, and combinations thereof.

14. The method of claim 12, wherein the steel is a member selected from the group consisting of a stainless steel, a carbon steel, a tool steel, and a steel alloy.

15. The method of claim 12, wherein the step of heating from about the A-sub 1 temperature is performed at least 1330 degrees Fahrenheit.

16. The method of claim 12, wherein A-sub 3 temperature ranges from about 1375 degrees Fahrenheit to about 2100 degrees Fahrenheit.

17. The method of claim 12, wherein the step of cooling of the steel occurs for a time ranging from about 1 second to about 3 hours.

18. The method of claim 12, wherein the step of cooling the austenitic steel with undissolved carbides is by air cooling or quenching.

19. The method of claim 18, wherein the step of quenching is by a member selected from the group consisting of: oil quenching, water quenching, salt quenching or air quenching.

20. The method of claim 12, wherein the step of cooling the steel is performed slowly at a temperature from just above 1330 degrees Fahrenheit to create a pearlite and ferrite crystalline matrix.

21. The method of claim 20, wherein the step of cooling the steel slowly steel is performed at a time ranging from about 5 minutes to about 6 hours.

22. The method of claim 12, wherein the carbides are formed by:

i. heating the steel without carbides to a temperature just below an A-sub 1 temperature; and ii. holding the heated steel at the temperature just below the A-sub 1 temperature for a time ranging from about 10 minutes to about 12 hours to form carbides in the steel.

23. The method of claim 12, wherein the carbides are formed by cyclically heating the steel without carbides at temperatures just above and just below the A-sub 1 temperature.

24. A method of making a steel article comprising carbide banding, comprising the steps of:

a. obtaining steel without carbides, wherein the steel comprises:

i. from about 0.3 weight percent to about 2.2 weight percent carbon; and ii. at least about 0.003 weight percent of a metal selected from the group consisting of chromium, molybdenum, aluminum, vanadium, or tungsten;

b. forming carbides by the steps comprising:

i. heating the steel without carbides to a temperature just below an A-sub 1 temperature; and ii. holding the heated steel at the temperature just below the A-sub 1 temperature for a time ranging between 10 minutes and 12 hours to form carbides in the steel;

c. heating the steel with formed carbides for a time less than about 5 minutes at a temperature above an A-sub 3 temperature forming an austenitic steel with undissolved carbides; and d. cooling the austenitic steel with undissolved carbides to maintain the undissolved carbides within a crystalline matrix and creating carbide banding in the steel.

25. The method of claim 24, wherein the step of heating above the A-sub 3 temperature ranges between 1375 degrees Fahrenheit and 2100 degrees Fahrenheit.

* * * * *